US011411339B2

(12) United States Patent
Peng et al.

(10) Patent No.: US 11,411,339 B2
(45) Date of Patent: Aug. 9, 2022

(54) APPARATUS AND METHOD FOR MODIFYING AN ELECTRICAL CIRCUIT

(71) Applicant: R.S.M. Electron Power, Inc., Deer Park, NY (US)

(72) Inventors: David Peng, Flushing, NY (US); Ching Au, Garden City, NY (US)

(73) Assignee: R.S.M. Electron Power, Inc., Deer Park, NY (US)

( * ) Notice: Subject to any disclaimer, the term of this patent is extended or adjusted under 35 U.S.C. 154(b) by 170 days.

(21) Appl. No.: 16/992,601

(22) Filed: Aug. 13, 2020

(65) Prior Publication Data

US 2021/0305744 A1 Sep. 30, 2021

Related U.S. Application Data

(60) Provisional application No. 62/993,950, filed on Mar. 24, 2020.

(51) Int. Cl.

| | |
|---|---|
| ***H01R 13/24*** | (2006.01) |
| ***H01R 13/516*** | (2006.01) |
| ***H01R 13/187*** | (2006.01) |
| ***H01R 4/01*** | (2006.01) |
| ***H01R 13/70*** | (2006.01) |

(52) U.S. Cl.

CPC ..... *H01R 13/2478* (2013.01); *H01R 4/01* (2013.01); *H01R 13/187* (2013.01); *H01R 13/516* (2013.01); *H01R 13/70* (2013.01)

(58) Field of Classification Search

CPC .... H01R 13/2478; H01R 4/01; H01R 13/187; H01R 13/516; H01R 13/70; H01H 2037/768; H01H 37/761

See application file for complete search history.

(56) References Cited

U.S. PATENT DOCUMENTS

2012/0194958 A1* 8/2012 Matthiesen ..... H01H 37/761 361/103

FOREIGN PATENT DOCUMENTS

| | | | | |
|---|---|---|---|---|
| EP | 0202564 A2 * | 11/1986 | | |
| KR | 101752696 B1 * | 7/2017 | | |
| WO | WO-2012081266 A1 * | 6/2012 | ..... | H01R 4/304 |

* cited by examiner

*Primary Examiner* — Travis S Chambers
(74) *Attorney, Agent, or Firm* — Venable LLP

(57) ABSTRACT

An apparatus for modifying an electrical circuit includes a first electrical contact, a second electrical contact, an electrical coupler formed of an electrically conductive material, a first assembly including a cavity, a driving portion, an inhibiting portion, and a second assembly electrically coupled to the second electrical contact. The electrical coupler is moveable within the cavity along a movement axis, a wall of the cavity is electrically coupled to the first electrical contact and to the electrical coupler, and when the electrical coupler is disposed at an initial position within the cavity, the electrical coupler is not electrically coupled to the second electrical contact. The driving portion applies a first force on the electrical coupler in a movement direction along the movement axis. The inhibiting portion inhibits the movement of the electrical coupler along the movement axis.

15 Claims, 11 Drawing Sheets

APPARATUS AND METHOD FOR MODIFYING AN ELECTRICAL CIRCUIT

CROSS-REFERENCE TO RELATED APPLICATIONS

This application claims the benefit under 35 U.S.C. § 119(e) of U.S. Provisional Patent Application No. 62/993,950, filed Mar. 24, 2020, and titled "Apparatus and Method for Modifying an Electrical Circuit," the entirety of which is incorporated herein by reference.

FIELD OF THE INVENTION

The invention relates to an apparatus and method for modifying an electrical circuit.

BACKGROUND OF THE INVENTION

In the electrical circuit art, it is often desirable to incorporate a circuit modifier that modifies an electrical circuit based on electrical or environmental conditions. However, it is difficult to design a circuit modifier that deploys with precise control. For instance, the modification mechanisms in conventional circuit modifiers are unpredictable and may either deploy too quickly or too slowly when the trigger condition is met.

Therefore, there is a need for a circuit modifier that precisely controls the deployment of the modification mechanism upon satisfaction of the trigger condition.

SUMMARY OF THE INVENTION

In one aspect, the invention relates to an apparatus comprising a first electrical contact, a second electrical contact, an electrical coupler formed of an electrically conductive material, a first housing including a cavity in which the electrical coupler is disposed, wherein (i) the electrical coupler is moveable within the cavity along a movement axis, (ii) a wall of the cavity is electrically coupled to the first electrical contact and to the electrical coupler, and (iii) when the electrical coupler is disposed at an initial position within the cavity, the electrical coupler is not electrically coupled to the second electrical contact, a driving portion including an expanding material that expands as the temperature of the apparatus exceeds a predetermined temperature, the driving portion applying a first force on the electrical coupler in a movement direction along the movement axis as the expanding material expands, an inhibiting portion coupled to one of the electrical coupler and the wall of the cavity, the inhibiting portion applying a second force against the other of the electrical coupler and the wall of the cavity to inhibit movement of the electrical coupler along the movement axis, and a second housing electrically coupled to the second electrical contact, wherein the apparatus is configured such that, in a case that the electrical coupler moves a predetermined distance in the movement direction from the initial position, the electrical coupler physically contacts the second housing, and the first electrical contact is electrically coupled to the second electrical contact via the electrical coupler, the first housing, and the second housing.

In another aspect, the invention relates to a method of modifying a path within an electrical circuit, comprising providing an electrical coupler formed of an electrically conductive material at an initial position in a cavity of a first housing, wherein (i) the electrical coupler is moveable within the cavity along a movement axis, (ii) a wall of the cavity is electrically coupled to a first electrical contact and to the electrical coupler, and (iii) when the electrical coupler is disposed at the initial position, the electrical coupler is not electrically coupled to a second electrical contact, applying, in a case that an ambient temperature exceeds a predetermined temperature, a first force on the electrical coupler in a movement direction along the movement axis, the force being applied based on expansion of a material that expands as the ambient temperature exceeds the predetermined temperature, applying a second force on one of the electrical coupler and the wall of the cavity, the second force inhibiting movement of the electrical coupler along the movement axis, and physically contacting, in a case that the electrical coupler moves a predetermined distance in the movement direction from the initial position, the electrical coupler and a second housing, such that the first electrical contact is electrically coupled to the second electrical contact via the electrical coupler, the first housing, and the second housing.

In a further aspect, the invention relates to a method of producing an electrical circuit path modifier that includes an electrical coupler, a driving portion, and an inhibiting portion, wherein the electrical coupler is electrically coupled to a first electrical contact but is not electrically coupled to a second electrical contact when disposed at an initial position, and is electrically coupled to both the first electrical contact and the second electrical contact when disposed at a second position, the method comprising setting a plurality of deployment parameters for the electrical circuit path modifier, the deployment parameters including (i) a condition under which movement of the electrical coupler from the initial position to the second position initiates, and (ii) a timing for the electrical coupler to move from the initial position to the second position upon the condition being satisfied, determining, based on the timing and a distance between the initial position and the second position, a rate of movement of the electrical coupler, and determining, based on the rate of movement (i) at least one first parameter for the driving portion, the driving portion producing a first force causing movement of the electrical coupler from the initial position to the second position upon the condition being satisfied, and (ii) at least one second parameter for the inhibiting portion, the inhibiting portion producing a second force, the second force inhibiting the movement of the electrical coupler from the initial position to the second position.

These and other aspects of the invention will become apparent from the following disclosure.

DETAILED DESCRIPTION OF THE PREFERRED EMBODIMENTS

Figure 1:
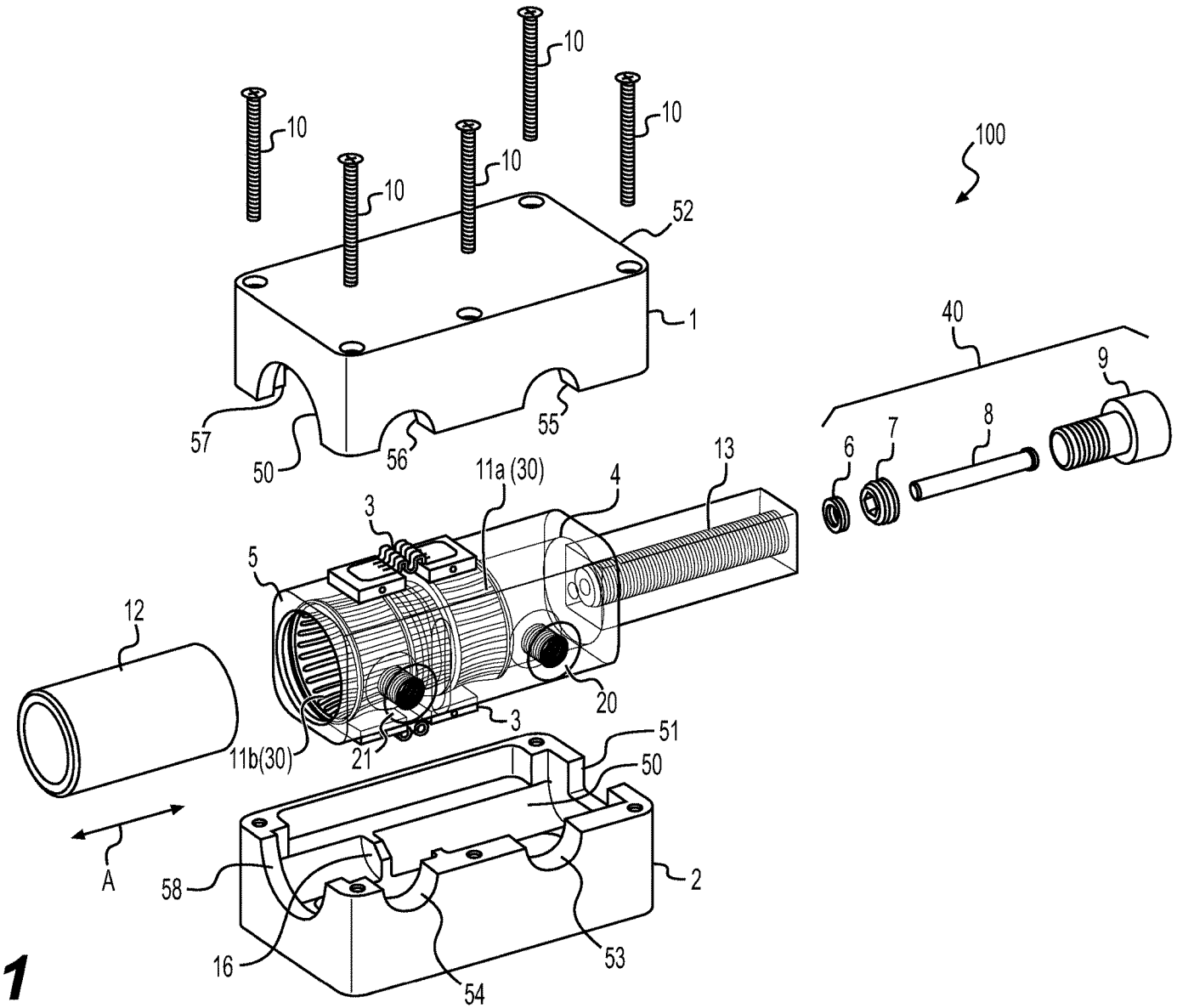
FIG. 1 is an exploded view of an apparatus in accordance with a first embodiment of the invention.

As illustrated in FIG. 1, the apparatus 100 includes an upper cover 1, a lower cover 2, a cathode assembly 4, and an anode assembly 5. The upper cover 1 and the lower cover 2 are fastened to each other using one or more fastening mechanisms 10. In one embodiment, the fastening mechanisms 10 are screws or bolts. Although FIG. 1 illustrates the fastening mechanisms 10 as screws of the same size, it will be appreciated that the apparatus may alternatively incorporate multiple different types and/or sizes of fastening mechanisms, and/or other known forms of fastening mechanisms. When fastened together, the upper cover 1 and the lower cover 2 define an interior space 50 bounded by interior walls.

Figure 2A:
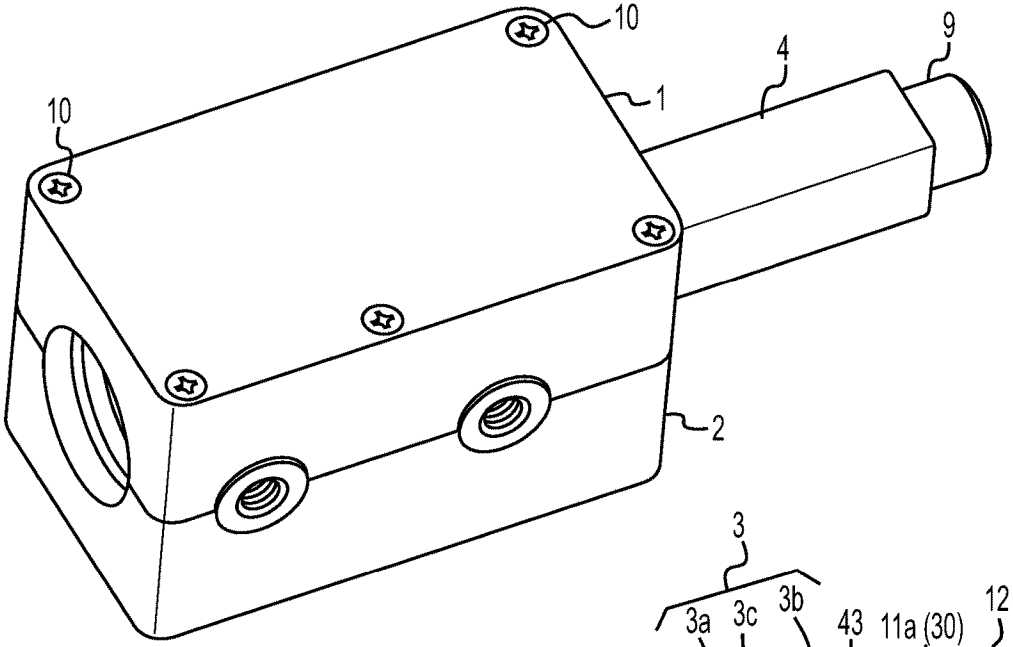
FIGS. 2A and 2B are final-assembled and cut-away views, respectively, of the apparatus in accordance with the first embodiment of the invention.
Figure 2B:
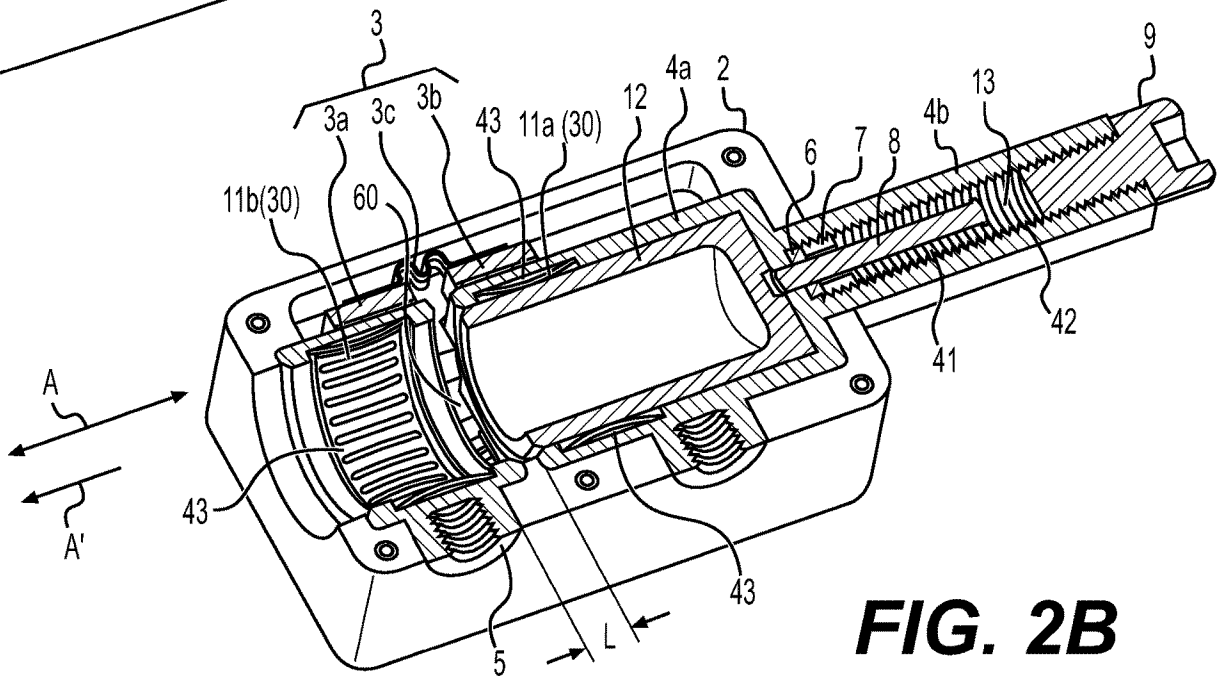

The cathode assembly 4 and the anode assembly 5 operate collectively as a diode with controlled flow of current from the anode assembly 5 to the cathode assembly 4. The cathode assembly 4 is preferably formed as an integral unit with an interior cathode assembly 4*a* and an exterior cathode assembly 4*b*, as illustrated in FIG. 2B. The interior cathode assembly 4*a* and the anode assembly 5 are disposed in the interior space 50, while the exterior cathode assembly 4*b* is disposed outside of the interior space 50 and protrudes out from the upper and lower covers 1 and 2. In one embodiment, the lower cover 2 includes a cut-out 51 to accommodate the lower portion of the exterior cathode portion 4*b* to protrude out from the lower cover 2, and the upper cover 1 includes a similar cut-out 52. In one embodiment, only one of the upper cover 1 and the lower cover 2 includes the cut-out opening to accommodate the protrusion of the exterior cathode assembly 4*b*.

The interior cathode assembly 4*a* and the anode assembly 5 are seated and retained in the interior space 50. In one embodiment, the interior cathode assembly 4*a* and the anode assembly 5 have an exterior profile that corresponds to the profile of the interior space 50. In one embodiment, one or both of the upper cover 1 and the lower cover 2 includes one or more protrusions 16, and the interior cathode assembly 4*a* and the anode assembly 5 are sized such that they are securely seated in a space bounded by the protrusions 16 and the upper and lower cover walls defining the interior space 50, thereby restricting movement of the interior cathode portion 4*a* and the anode portion 5 within the interior space 50. Of course, it will be appreciated that the upper cover 1, the lower cover 2, the cathode assembly 4 and/or the anode assembly 5 may incorporate alternative or additional retention mechanisms, such as adhesives, screws, bolts, clips, etc., to secure these components to one another.

The interior cathode assembly 4*a* and the anode assembly 5 are electrically coupled to each other with a diode assembly 3. In one embodiment, the diode assembly 3 includes one or more diode chips that operate as a heat-generating mechanism that generates heat when electrically current passes therethrough. The properties of the diode chip(s) within the diode assembly 3, such as its size, material, and thermal resistance of its packaging, may be selected based on a desired amount of heat to be generated when certain amount of current passes therethrough. The diode assembly 3 may also be physically coupled or mounted to various components within the system, such as the interior cathode assembly 4*a* and/or the anode assembly 5, to convey the generated heat to these components. It will be appreciated that the diode assembly 3 may be alternatively formed of other components other than diode chips, such as a single resistor or a resistor network.

In one embodiment, the diode assembly 3 includes two hermetically-sealed silicon diodes 3*a*, 3*b* (known as diopacks) connected in series by a strain-relief terminal 3*c*. In one embodiment, one or both diopacks includes a silicon diode sealed in between an electrically-insulative ceramic frame and two electrically-conductive plates disposed above and below the ceramic frame. In one embodiment, each diopack is hermetically tested to military test standards to provide long-term reliability. In one embodiment, each diode 3*a*, 3*b* is implemented as a Schottky diode.

In one embodiment, the diode assembly 3 limits the flow of electrical current in only one direction. When the apparatus 100 is installed in a system as an electrical protection component, a circuit fault arising during system operation causes the diodes 3*a*, 3*b* to generate heat which triggers the driving portion 40, as described in further detail below. In one embodiment, the apparatus 100 includes a single diode assembly 3. In one embodiment, the apparatus 100 includes a plurality of diode assemblies 3.

The interior cathode assembly 4*a* includes a first electrical contact 20, and the anode assembly 5 includes a second electrical contact 21. In one embodiment, the first and second electrical contacts 20 and 21 are formed as electrical receptacles (e.g., sockets) or electrical plugs. However, it will be appreciated that the first and second electrical contacts 20 and 21 may alternatively be formed as any other known type of electrical coupling. In one embodiment, the upper cover 1 and/or the lower cover 2 include cut-outs 53-56 to allow external access to the first and second electrical contacts 20 and 21. In one embodiment, the upper cover 1 and/or the lower cover 2 include cut-outs 57-58 to allow external access to the electrical coupler 12 by an operator.

The interior cathode assembly 4*a* and the anode assembly 5 both contain an interior space, and collectively define an internal cavity 60 based on their interior walls. The interior walls of the interior cathode assembly 4*a* are electrically coupled to the first electrical contact 20, and the interior walls of the anode assembly 5 are electrically coupled to the second electrical contact 21.

The interior cathode assembly 4*a* includes an electrical coupler 12 disposed in the internal cavity 60. The electrical coupler 12 is used to switchably couple the cathode assembly 4 to the anode assembly 5, to transition the apparatus 100 from a first circuit state to a second circuit state. In one embodiment, the electrical coupler 12 is formed as an electrically-shorting piston. In one embodiment, the electrical coupler 12 is made of an electrically conductive material such as, but not limited to, copper (e.g., ETP copper or beryllium copper), brass, and/or gold. However, it will be appreciated that the electrical coupler 12 may alternatively be formed of other materials and shapes. In one embodiment, the electrical coupler 12 is cylindrical in shape with a circular exterior cross-section, and the walls of the interior cavity 60 likewise have a circular cross-section.

The electrical coupler 12 is electrically coupled to the portion of the walls of the interior cavity 60 to which it is in physical contact. It is noted that the electrical coupler 12 may only be in physical contact with a portion of the respective interior wall along the circumferential direction.

The electrical coupler 12 is movable within the interior cavity 60 along an axis A. In one embodiment (shown in FIG. 2B), the electrical coupler 12 is initially positioned within a portion of the interior cavity 60 defined solely by the interior walls of the interior cathode assembly 4*a*. In particular, the electrical coupler 12 is initially positioned such that it is not in physical contact with the interior walls of the anode assembly 5, and therefore is not electrically coupled to the anode assembly 5. In one embodiment, the electrical coupler 12 is initially spaced from the interior walls of the anode assembly 5 by a distance L along the axis A (see FIG. 2B).

In one embodiment, the second electrical contact 21 receives a current from outside of the apparatus 100. When the apparatus 100 is in a first circuit state (where the electrical coupler 12 is not electrically coupled to the anode assembly 5), the received current is transferred to the cathode assembly 4 exclusively via the diode assembly 3, and is transferred out of the apparatus 100 via the first electrical contact 20. When the apparatus 100 is in a second circuit state (where the electrical coupler 12 is electrically coupled to the anode assembly 5), the received current is transferred to the cathode assembly 4 via both the diode assembly 3 and the electrical coupler 12, and is transferred out of the apparatus 100 via the first electrical contact 20. In one embodiment, when the apparatus 100 is in the second circuit state, the received current bypasses the diode assembly 3 and is transferred via only the electrical coupler 12.

Driving Portion

Aspects of a driving portion 40 of the apparatus will now be discussed. In one embodiment, the exterior cathode assembly 4*b* contains the driving portion 40 and an internal cavity 41. The driving portion 40 includes a seal 6, a hollow set screw 7, a trigger rod 8, a seal 9, and an expanding material 13. The interior walls defining the cavity 41 preferably include internal threads 42 (see FIGS. 1 and 2B).

The seal 6 restricts undesired contaminants from entering the interior cathode assembly 4*a*, and is preferably a rubber O-ring with an inner passage. The hollow set screw 7 contains an interior passage and external threads that mate with the internal threads 42, and is threaded in the cavity 41 to secure the seal 6 against the interior cathode assembly 6*a*. The trigger rod 8 is preferably cylindrical with a diameter and a profile corresponding to those of the interior passages of the seal 6 and the hollow set screw 7, such that the trigger rod 8 is moveable along the axis A through the interior passages of the seal 6 and the hollow set screw 7. The seal 9 is preferably a sealing bolt 9 with external threads that mate with the internal threads 42, and is threaded in the cavity 41 at the outer end of the exterior cathode assembly 4*b* to seal the exterior cathode assembly 4*b* from the outside.

The expanding material 13 is a material with a predetermined coefficient of expansion, such that the material expands in a known manner as the temperature of the material increases by a particular amount. The expanding material 13 is preferably paraffin wax having a known characteristic. The expanding material 13 is also provided in a predetermined quantity.

Inhibiting Portion

Various aspects of an inhibiting portion 30 of the apparatus will now be discussed. In one embodiment, the inhibiting portion 30 includes a biasing element 11*a* integrated with the interior cathode assembly 4*a*, and a biasing element 11*b* integrated with the anode assembly 5. In one embodiment, each of the biasing elements 11*a* and 11*b* is a single-contact or multi-contact spring connector. In one embodiment, each of the biasing elements 11*a* and 11*b* is a multi-contact spring connector. Other alternative types of biasing elements that may be used as the biasing elements 11*a* and 11*b* may include hardware with mechanically knurled surfaces (e.g., continuous or segmented) or hardware with various surface finish callout at various micro-inch levels (continuous or segmented (e.g. rough patches)), or hardware with embedded protrusions that provide elevated friction offer stopping power (e.g., rubber dots, viscoelastic material, etc.) due to frictional (or other interference) forces or forces normal to the traversing axis that translate clamping force to frictional (or other interference) forces. It will further be appreciated that the biasing elements 11*a* and 11*b* may be the same type or different types. The following description will be presented based on each of the biasing elements 11*a* and 11*b* as a multi-contact spring connector. However, it will be appreciated that these descriptions may be applicable towards a single-contact spring connector or other form of biasing element.

The multi-contact spring connector 11*a* is mounted to the interior of the interior cathode assembly 4*a*, such that it constitutes the internal wall of the interior cathode assembly 4*a*. The multi-contact spring connector 11*a* and includes a plurality of spring fins 43. In one embodiment, the multi-contact spring connector 11*a* is generally cylindrical in shape, with a circular cross-section. In one embodiment, the spring fins 43 are provided at spaced intervals along the circumference of the circular cross-section. In one embodiment, the spring fins 43 are biased towards the radial inward direction of the circular cross-section, and retract in the radial outward direction of the circular cross-section when an opposing force is applied against the biasing force.

The multi-contact spring connector 11*b* is mounted to the interior of the anode assembly 5, such that it constitutes the internal wall of the anode assembly 5. The multi-contact spring connector 11*b* likewise includes a plurality of spring fins 43. In one embodiment, the multi-contact spring connector 11*b* is similar in structure and configuration to the multi-contact spring connector 11*a*, with the above-described aspects of the multi-contact spring connector 11*a* also applying thereto. It will also appreciated that the multi-contact spring connector 11*b* may have a different configuration from the multi-contact spring connector 11*a*, such as a different quantity or placement of spring fins 43 or a different spring biasing force for each spring fin 43. In one embodiment, the multi-contact spring connector 11*b* is omitted from the apparatus 100.

When the spring fins 43 contact the electrical coupler 12, the spring fins 43 apply a force upon the electrical coupler 12, thereby increasing the frictional resistance between the electrical coupler 12 and its surrounding and inhibiting the movement of the electrical coupler 12 along the axis A.

Operation

The operation of the apparatus 100 will now be described. As described above, the apparatus 100 is initially arranged such that the electrical coupler 12 is not in physical contact with the anode assembly 5, and therefore is not electrically coupled to the anode assembly 5. Therefore, the apparatus 100 is initially in the first circuit state, with current received at the second electrical contact 21 being transferred from the anode assembly 5 to the cathode assembly 4 solely through the diode assembly 3 (and not through the electrical coupler 12).

As the electrical current passing through the apparatus 100 increases, an amount of heat loss in the apparatus 100 likewise increases, thereby increasing the temperature within the apparatus 100. For instance, in one embodiment, when electrical current passing through the apparatus 100 exceeds a threshold, the diode assembly 3 generates heat as a byproduct based on the electrical current flowing therethrough. When the temperature of the apparatus 100 exceeds a predetermined temperature, the expanding material 13 begins to expand within the cavity 41 in a predicted manner according to the known properties of the material.

When the above-described temperature constraints are satisfied, the driving portion 40 applies a force on the electrical coupler 12 in the direction A'. In particular, as the expansion of the expanding material 13 consumes the entire space within the cavity 41, the expanding material 13 begins to apply a force on the trigger rod 8. In turn, this force on the trigger rod 8 causes the trigger rod 8 to begin moving in a direction A' along the axis A. The trigger rod 8 contacts the electrical coupler 12, causing the force on the trigger rod 8 to be transferred to the electrical coupler 12. With sufficient force applied thereon to overcome static friction, the electrical coupler 12 begins moving along the axis A in the direction A'.

The inhibiting portion 30 inhibits the movement of the electrical coupler 12 along the axis A. As described above, the spring fins 43 of the multi-contact spring connector 11*a* impose a force against the electrical coupler 12 in the radial inward direction of the circular cross-section of the multi-contact spring connector 11*a*. This force increases the contacting friction between the electrical coupler 12 and the interior cathode assembly 4*a* (including the multi-contact spring connector 11*a*), thereby providing increased resistance against movement of the electrical coupler 12 along the axis A. In effect, the resistance provided by the multi-contact spring connector 11*a* is a force opposed to that provided by the driving portion 40, that slows the movement of the electrical coupler 12 in the direction A' by a predetermined amount. The particular predetermined amount is controlled based on the design of the apparatus 100, based at least on the quantity of spring fins 43 within the multi-contact spring connector 11*a*, the biasing spring force provided by each spring fin 43, and other physical characteristics which may influence the resistance.

Once the electrical coupler 12 has traversed the distance L in the direction A', the electrical coupler 12 comes into physical contact with the anode assembly 5, thereby electrically connecting the cathode assembly 4 and the anode assembly 5 through the electrical coupler 12. At this point, the circuit provided by the apparatus 100 is modified, and the apparatus 100 transitions to the second circuit state. In this state, current received at the second electrical contact 21 is transferred from the anode assembly 5 to the cathode assembly 4 through both the diode assembly 3 and the electrical coupler 12 (or exclusively through the electrical coupler 12).

In one embodiment, the biasing element 11*a* is electrically coupled to the cathode 4 and facilitates electrical contact between the cathode 4 and the electrical coupler 12 in both the first and circuit states. In one embodiment, the biasing element 11*b* is electrically coupled to the anode 5 and facilitates electrical contact between the anode 5 and the electrical coupler 12 in the second circuit state.

Notably, the use of the inhibiting portion 30 may provide improved control and accuracy over the travel characteristics of the electrical coupler 12. As this force provided by the driving portion 40 may be excessive and difficult to accurately control, and may cause the rate of travel of the electrical coupler 12 to exceed a desired speed, the inhibiting portion 30 slows the rate of travel of the electrical coupler and inhibits its motion by a controlled extent based on the properties of the spring fins 43. By providing the multi-contact spring connectors to inhibit the rate of travel, the rate of travel of the piston may be precisely controlled, as compared to the rate of travel being dictated only by the expansion of the expanding material in the driving portion 40.

In one embodiment, the rear portion of the trigger rod 8 has increased width relative to the forward portion of the trigger rod 8, and the interior passage of the hollow set screw 7 has a width smaller than that of the trigger rod 8 rear portion. As such, the set screw 7 stops further travel of the trigger rod 8 when the rear portion of the trigger rod 8 contacts the set screw 7. In one embodiment, the trigger rod 8 has length and width dimensions defining a length of travel sufficiently long to allow the apparatus 100 to transition to the second circuit state, yet sufficiently short to prevent the electrical coupler 12 from exiting the apparatus 100.

A desired rate of travel of the electrical coupler 12 is controlled through selection of various design factors or variables. For instance, the rate of travel of the electrical coupler 12 may be controlled through selection of the amount of expanding material. Providing a greater amount of expanding material (e.g., wax) or a smaller cavity 41 may increase the rate of travel, while providing a smaller amount of material or a larger cavity 41 may decrease the rate of travel. The rate of travel of the electrical coupler 12 may also be controlled through selection of a particular expanding material. An expanding material having a lower melting temperature (e.g., a lower melting temperature wax) may increase the rate of travel, while an expanding material having a higher melting temperature may decrease the rate of travel. Notably, the rate of travel may increase when electrical current increases through the electrical circuit (e.g., due to increased translated heat loss), and may conversely decreases when the electrical current decreases.

The rate of travel of the electrical coupler 12 may further be controlled by selecting the characteristics (e.g., spring stiffness) of the inhibiting portion 30. A multi-contact spring connector with stiffer spring fins 43 producing a greater amount of friction between the electrical coupler 12 and the spring fins 43 may provide a greater amount of decrease in the rate of travel, while a less-stiff spring fin 43 may provide a lesser amount of decrease. Increasing the number of multi-contact spring connectors 11*a* and/or the number of spring fins 43 on each multi-contact spring connector 11*a* may also provide a greater amount of decrease in the rate of travel.

Therefore, the exact rate of deployment of the electrical coupler 12 may be controlled based on selected components of the apparatus. That is, the rate of deployment may be controlled by determining, e.g., under a certain amount of current producing a certain amount of heat, the amount of time (e.g., seconds or minutes) that the electrical coupler 12 will travel a certain distance (e.g., distance L), in order to deploy and modify the circuit from the first circuit state to the second circuit state.

Second Embodiment

Figure 3:
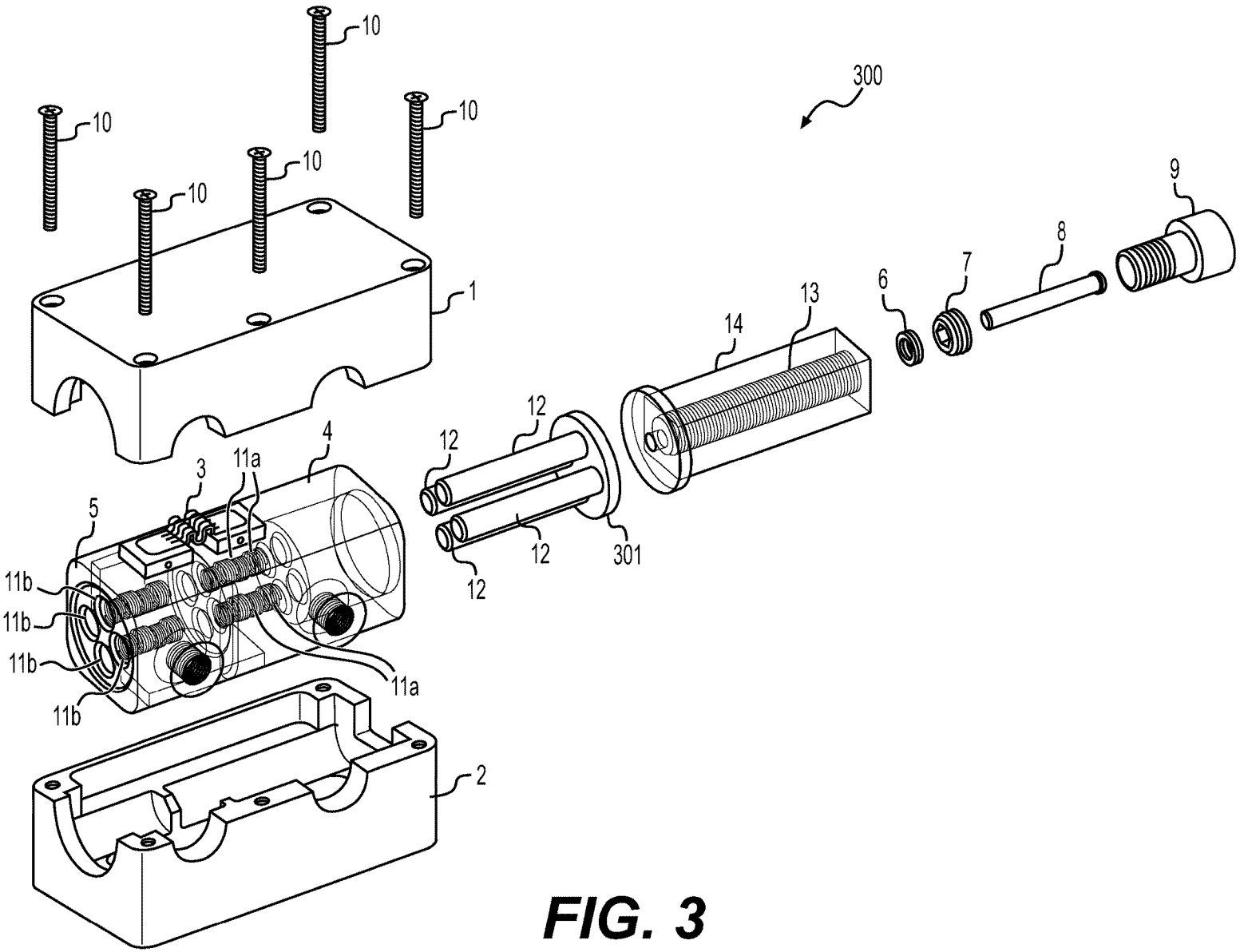
FIG. 3 is an exploded view of an apparatus in accordance with a second embodiment of the invention.
Figure 4A:
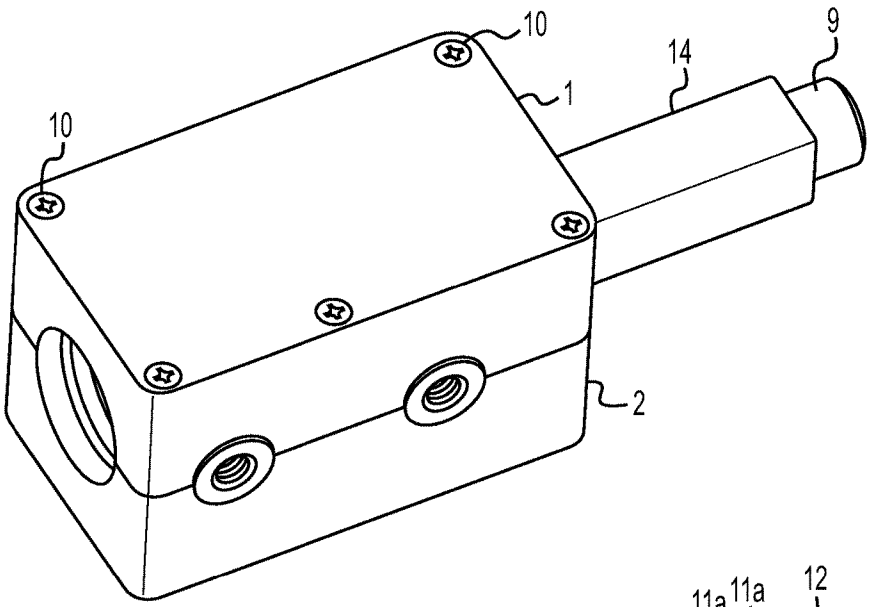
FIGS. 4A and 4B are final-assembled and cut-away views, respectively, of the apparatus in accordance with the second embodiment of the invention.
Figure 4B:
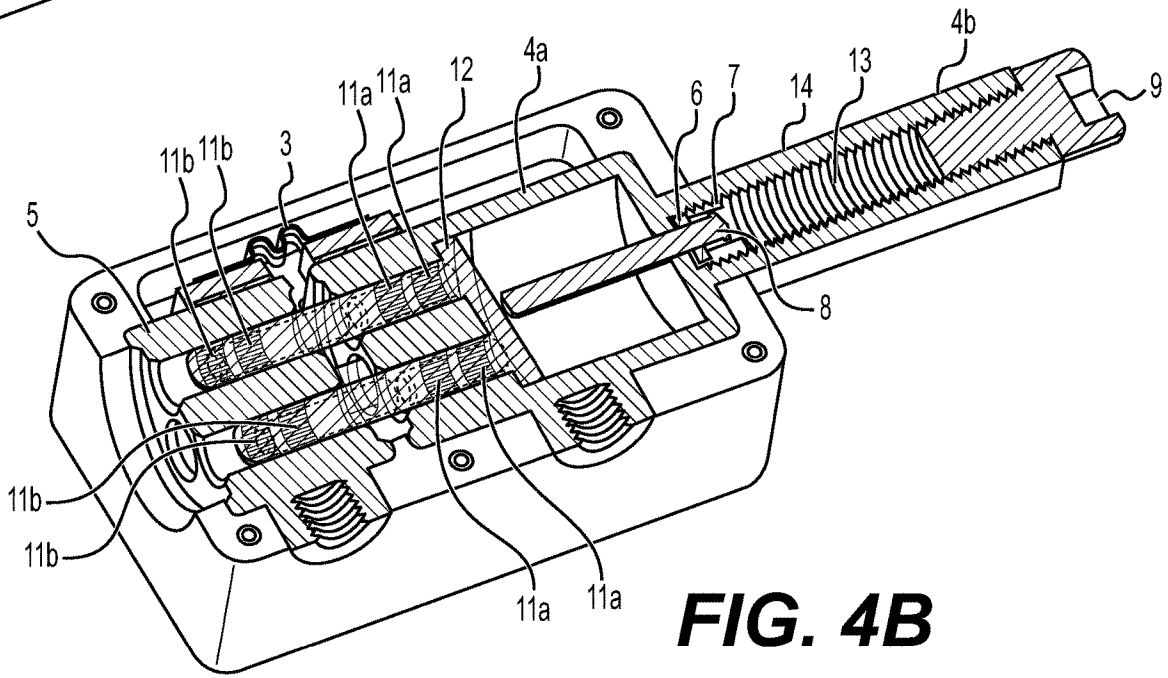

FIGS. 3 and 4A-4B illustrate an apparatus 300 according to a second embodiment of the invention. The apparatus 300 of the second embodiment differs from apparatus 100 of the first embodiment as follows.

While the apparatus 100 of the first embodiment includes a single electrical coupler 12, the apparatus 300 of the second embodiment includes multiple electrical couplers 12, and one or more biasing elements 11*a* and 11*b* are provided for each electrical coupler 12. In one aspect of the second embodiment, the multiple electrical couplers 12 are connected to a common base 301, and the trigger rod 8 applies force against the common base 301 to move all of the electrical couplers 12 in unison in the direction A'. The biasing elements 11*a* and 11*b* corresponding to each electrical coupler 12 provide increased resistance against movement of the respective electrical coupler 12 along the axis A. The anode assembly 5 is shaped so as to receive the electrical couplers 12. When the electrical couplers 12 advance a sufficient distance so as to contact the anode assembly 5, the circuit provided by the apparatus 300 is modified, and the apparatus 300 transitions from the first circuit state to the second circuit state.

Third Embodiment

Figure 5:
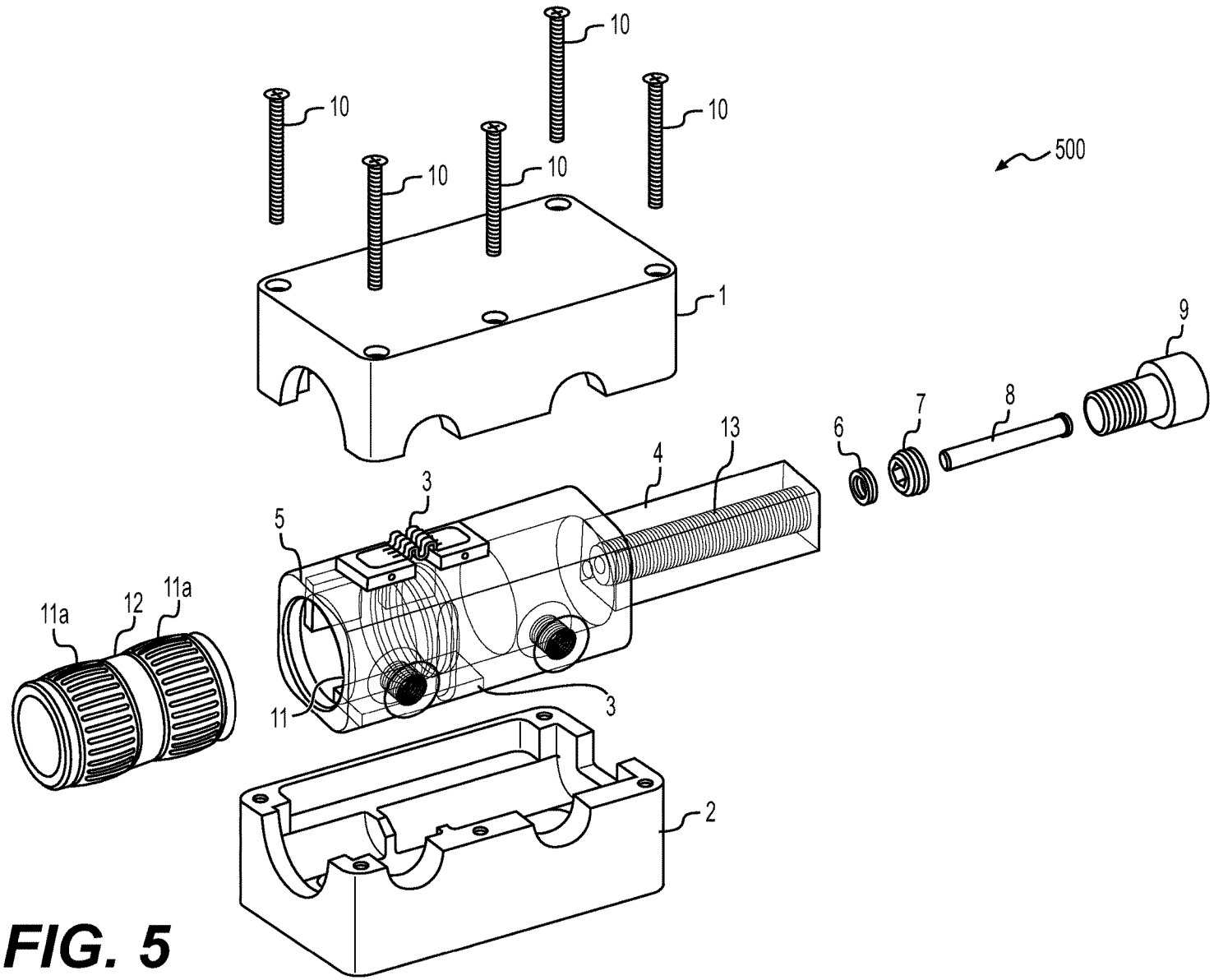
FIG. 5 is an exploded view of an apparatus in accordance with a third embodiment of the invention.
Figure 6A:
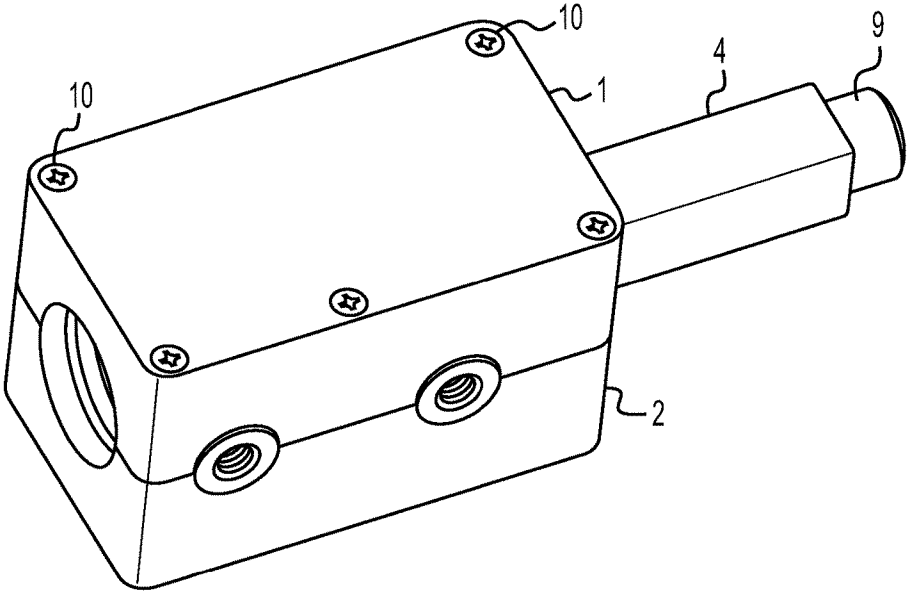
FIGS. 6A and 6B are final-assembled and cut-away views, respectively, of the apparatus in accordance with the third embodiment of the invention.
Figure 6B:
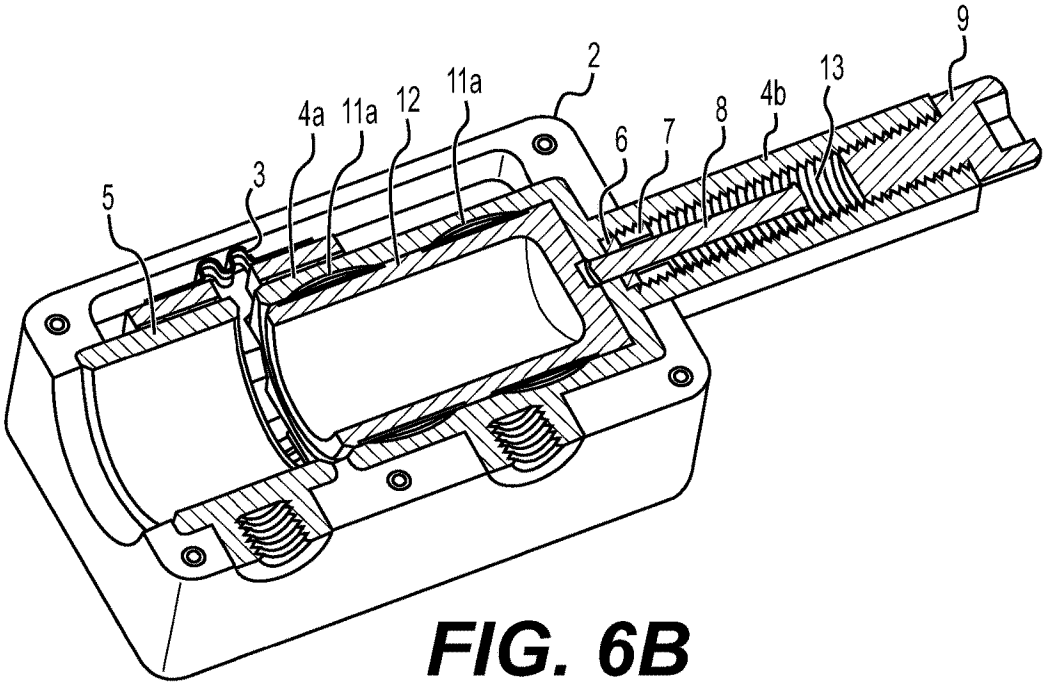

FIGS. 5 and 6A-6B illustrate an apparatus 500 according to a third embodiment of the invention. The apparatus 500 of the third embodiment differs from apparatus 100 of the first embodiment as follows.

In the first embodiment, the inhibiting portion 30 is provided on the interior cathode assembly 4*a* in the apparatus 100. On the other hand, in the third embodiment, the inhibiting portion 30 is provided on the electrical coupler 12. That is, the electrical coupler 12 includes one or more biasing elements 11*a* and 11*b*. In one example, the biasing elements 11*a* and 11*b* are each configured as a multi-contact spring connector with spring fins 43. However, instead of the spring fins 43 being biased towards the radial inward direction of the circular cross-section, the spring fins 43 in the apparatus 500 are biased towards the radial outward direction so as to contact the walls defining the cavity 60, increasing frictional resistance between the electrical coupler 12 and the walls.

Fourth Embodiment

Figure 7:
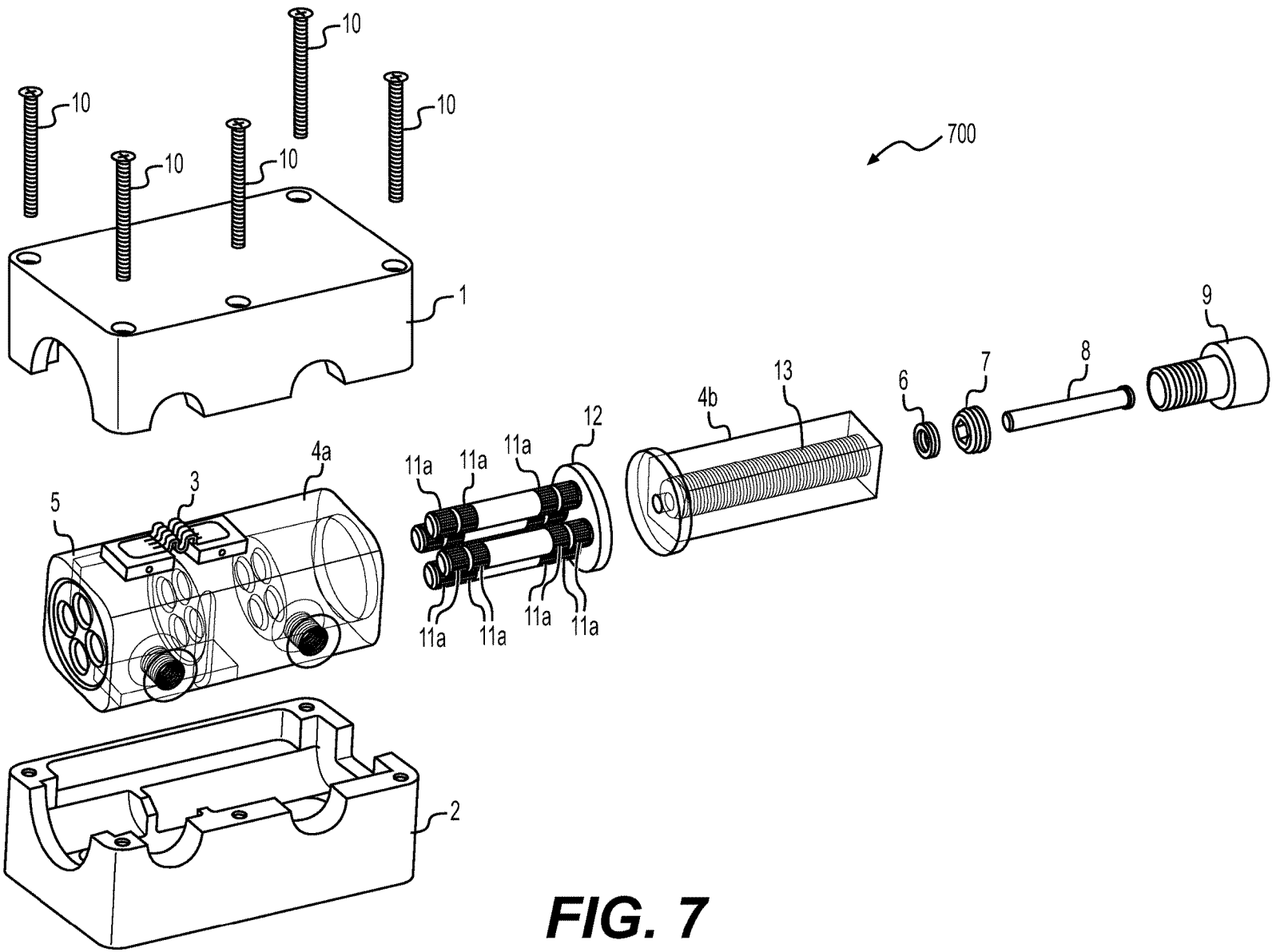
FIG. 7 is an exploded view of an apparatus in accordance with a fourth embodiment of the invention.
Figure 8A:
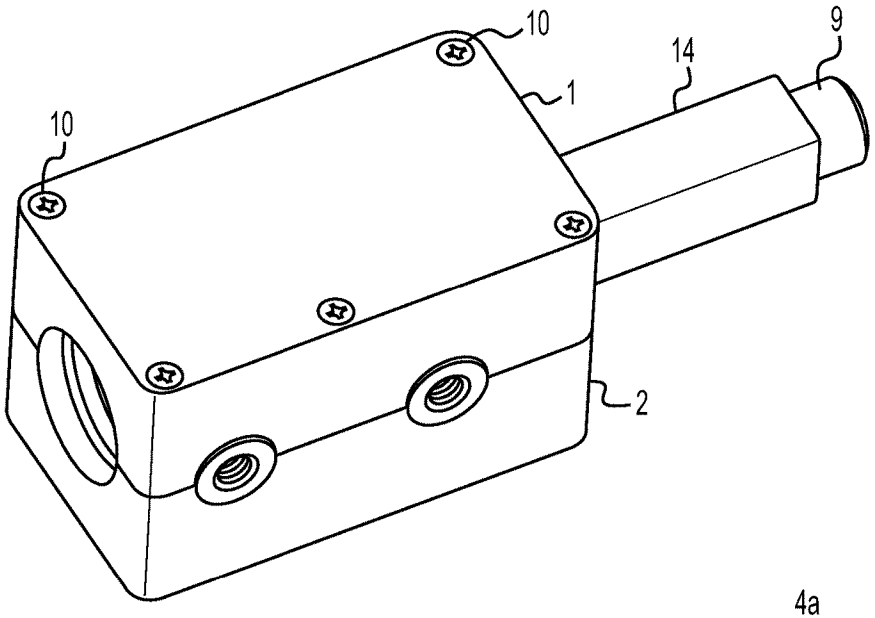
FIGS. 8A and 8B are final-assembled and cut-away views, respectively, of the apparatus in accordance with the fourth embodiment of the invention.
Figure 8B:
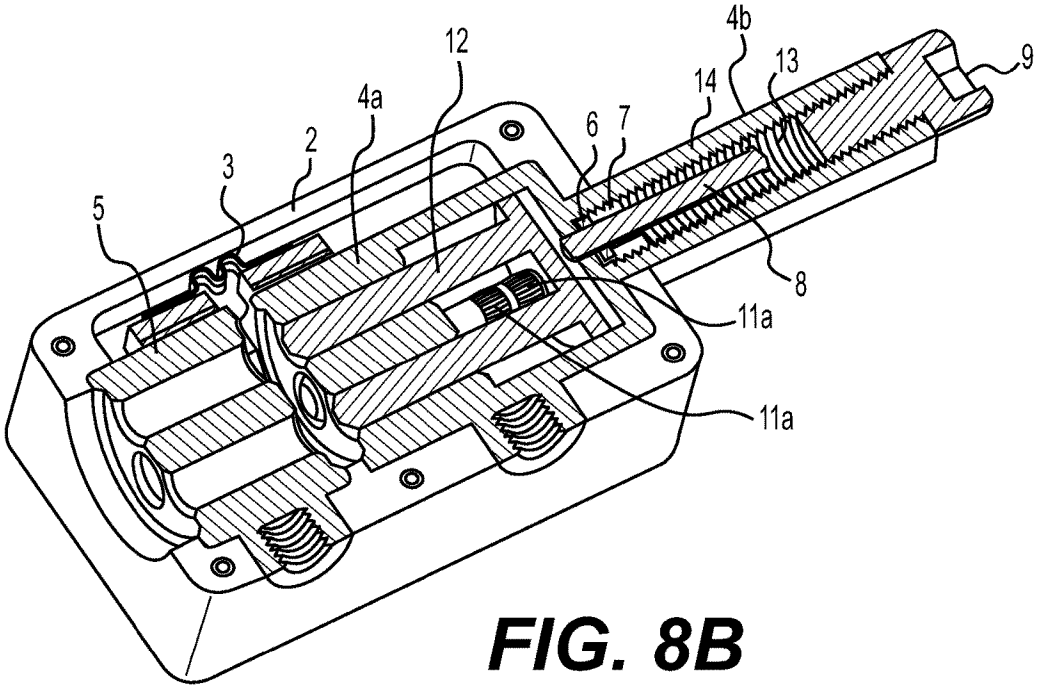

FIGS. 7 and 8A-8B illustrate an apparatus 700 according to a fourth embodiment of the invention. The apparatus 700 of the fourth embodiment differs from apparatus 100 of the first embodiment by combining the features of the second and third embodiments. That is, like the second embodiment, the apparatus 700 includes multiple electrical couplers 12 and one or more biasing elements 11*a* and 11*b* provided for each electrical coupler 12. And like the third embodiment, the biasing elements 11*a* and 11*b* are provided on each electrical coupler 12 rather than on the interior cathode assembly 4*a* and the anode assembly 5.

Apparatus Design and Production

Figure 9:
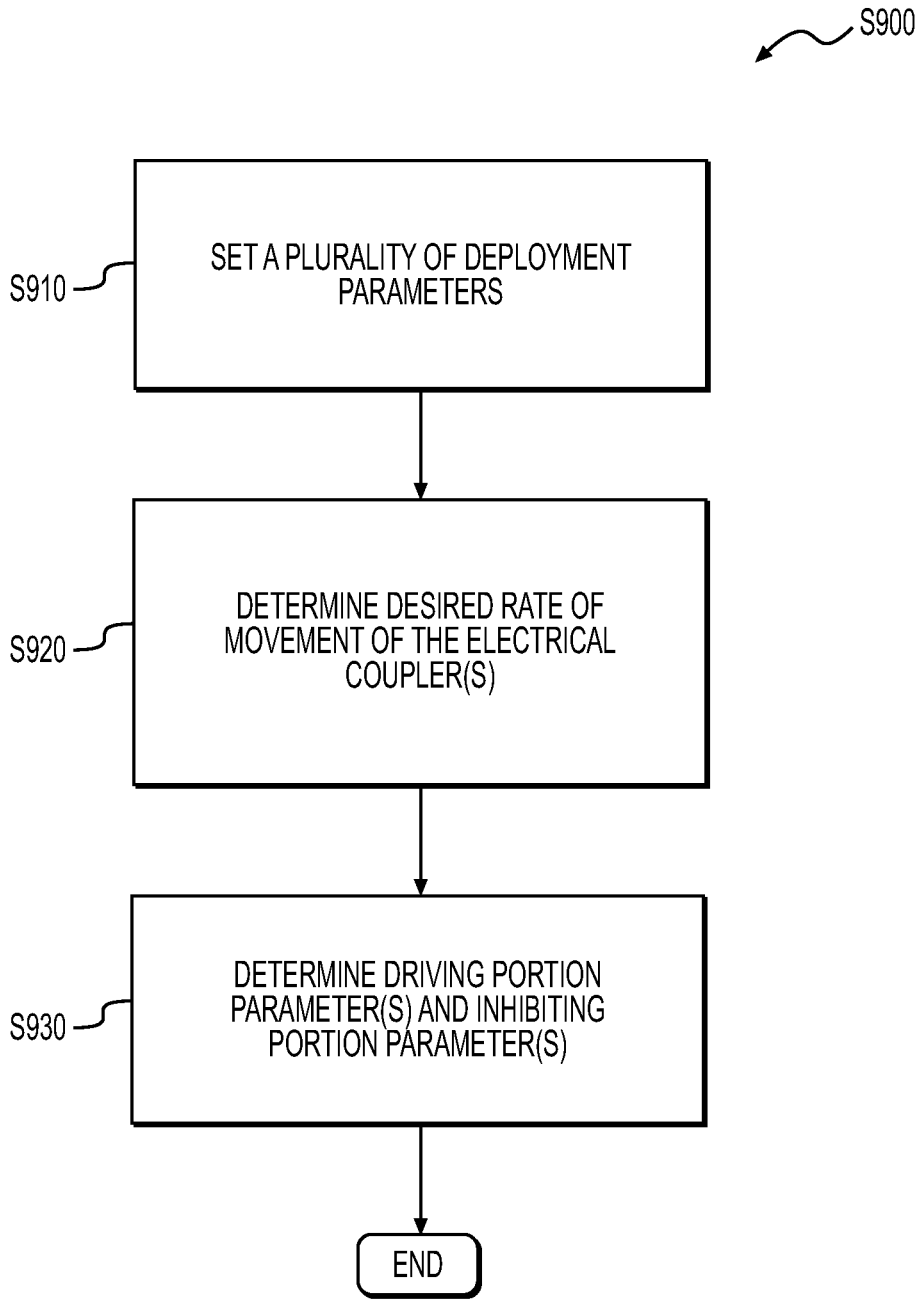
FIG. 9 is a flow diagram illustrating a process in accordance with an embodiment of the invention.

FIG. 9 illustrates a process S900 that may be employed to design and produce an apparatus according to one of the above embodiments.

In step S910, a designer sets a plurality of deployment parameters desired in the apparatus. A first deployment parameter may include a condition that triggers initial movement of the electrical coupler(s) from their initial position (in the first circuit state) towards the second position (in the second circuit state). Examples of such a deployment parameter include, but are not limited to, a threshold temperature and a threshold current passing through the apparatus. A second deployment parameter may include a desired timing for the apparatus to transition from the first circuit state to the second circuit state once the first deployment parameter is satisfied. Such desired timing may correspond to the timing for the electrical coupler to move from the initial position to the second position upon the first deployment parameter being satisfied. For example, the second deployment parameter may be a deployment time of 30 seconds once the first deployment parameter is satisfied.

In step S920, the designer determines a desired rate of movement of the electrical coupler(s) once the first deployment parameter is satisfied. This may be performed using (i) the timing set in step S910 and (ii) a distance between the initial position and the second position for the electrical coupler(s).

In step S930, the designer determines at least one driving portion parameter and at least one inhibiting portion parameter, based on the rate of movement determined in step S920. As already described above, the driving portion parameter(s) may include factors influencing the amount of driving force produced by the driving portion 40, including but not limited to, an amount or type of paraffin wax and/or the size of the cavity 41. And as already described above, the inhibiting portion parameter(S) may include factors influencing the amount of inhibiting force provided by the inhibiting portion 30, including but not limited to, the quantity of the one or more multi-contact spring connectors and a force produced by each multi-contact spring connectors.

Apparatus Re-Use Capability

In one aspect of the invention, the apparatus 100 may be reusable by, after being triggered from the first circuit state to the second circuit state, being reset back to its initial state. In one embodiment, after the apparatus 100 has transitioned to the second circuit state, the expanding material 13 may be in a liquid state. An operator may reset the device by disconnecting the apparatus 100 from the circuit, and inserting a finger or another object through an access port defined by cut-outs 57 and 58 to press the electrical coupler 12 back to to its initial position. In addition (or optionally), any air or other undesired substance(s) within the apparatus 100 may be removed (e.g., extricated) from the apparatus 100 to facilitate the return of the apparatus 100 to its original state. The expanding material 13 may be arranged so as to revert to its original non-expanded state when the temperature of the apparatus 100 returns to its original level.

In one embodiment, the re-use capability of the apparatus 100 allows testing of the apparatus 100 prior to its actual deployment in a system. For example, during manufacturing, an operator may test the apparatus 100 by applying an elevated current therethrough to intentionally trigger the apparatus 100 to transition from the first circuit state to the second circuit state. When the operator determines that the apparatus 100 has successfully triggered in accordance with its design, the operator may reset the apparatus 100, reverting the apparatus 100 back to its initial state. Such operation provides assurances that the actual apparatus 100 being delivered to a customer is functional.

Exemplary System Employing Apparatus 100

Figure 10B:
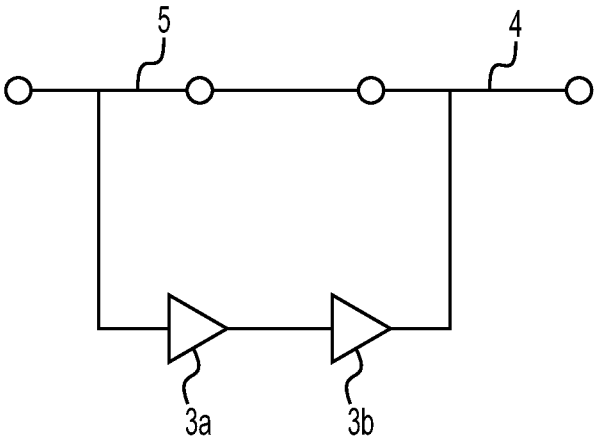
FIGS. 10A and 10B are circuit diagrams illustrating examples of the first and second circuit states respectively, in accordance with an embodiment of the invention.
Figure 10A:
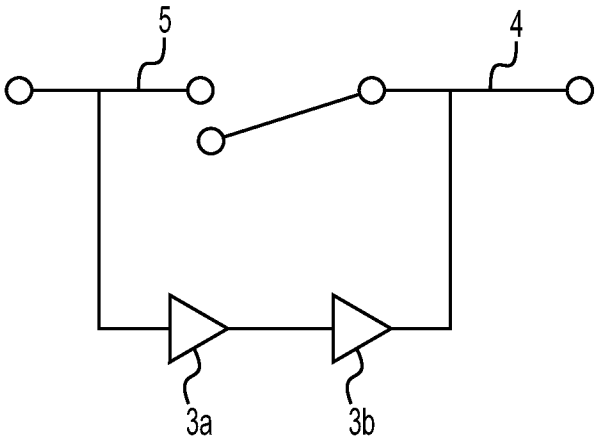

In one embodiment, the apparatus 100 in the first circuit state may be represented by the circuit diagram illustrated in FIG. 10A, and the apparatus 100 in the second circuit state may be represented by the circuit diagram illustrated in FIG. 10B.

Figure 11B:
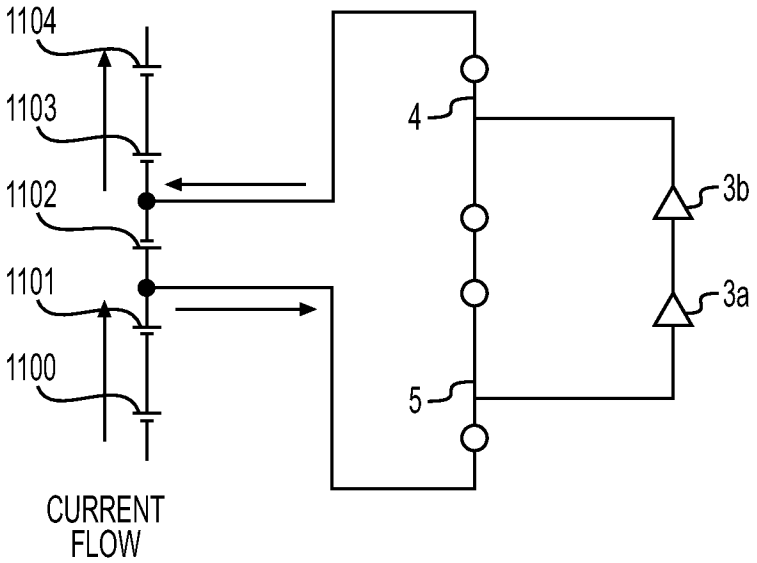
FIGS. 11A and 11B are circuit diagrams illustrating an exemplary system that incorporates the apparatus and is in a first and second state, respectively, in accordance with an embodiment of the invention.
Figure 11A:
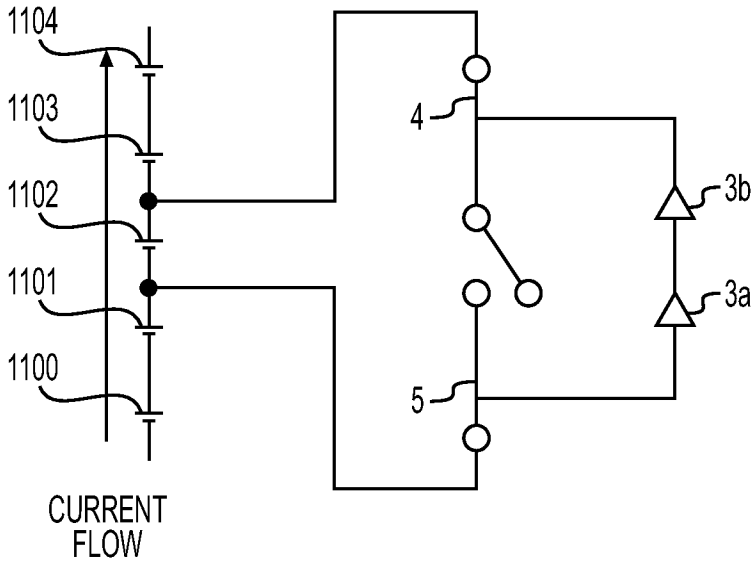

The apparatus 100 may be employed to protect a system from thermal overload. In one exemplary embodiment illustrated in FIGS. 11A and 11B, a system includes one or more batteries 1100-1104 and the apparatus 100. In a normal operation, electrical current flows through the batteries

1100-1104, with only limited current flowing through the diodes 3*a*, 3*b*. When the battery 1102 experiences an anomaly (e.g., faulty cell), the temperature of the apparatus 100 increases, due to excess heat generated in the battery 1102 and/or heat generated by increased current flowing through the diodes 3*a*, 3*b*. The excess heat causes the apparatus 100 to transition from the first circuit state to the second circuit state, causing the circuit and its current flow to bypass the battery 1102 and protect the system.

It will be appreciated that the rate of travel and the required travel distance to deploy the circuit modification is based on design preference. For instance, the rate of travel may range from virtually instantaneous to 5 minutes/inch. In one embodiment, the apparatus is configured with a 0.05 inch/second rate of travel, so as to require 20 seconds to travel 1 inch to deploy and modify the electrical circuit.

It will be appreciated that while the above description includes certain references to an anode and other references to a cathode, it will be appreciated that these aspects may be switched with each other without deviating from the invention. That is, in all of the above-described embodiments, the component corresponding to reference numeral 4 may constitute the anode, and the component corresponding to reference numeral 5 may constitute the cathode.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. An apparatus comprising:

a first electrical contact;

a second electrical contact;

an electrical coupler formed of an electrically conductive material;

a first housing including a cavity in which the electrical coupler is disposed, wherein:

(i) the electrical coupler is moveable within the cavity along a movement axis, (ii) a wall of the cavity is electrically coupled to the first electrical contact and to the electrical coupler, and (iii) when the electrical coupler is disposed at an initial position within the cavity, the electrical coupler is not electrically coupled to the second electrical contact;

a driving portion including an expanding material that expands as the temperature of the apparatus exceeds a predetermined temperature, the driving portion applying a first force on the electrical coupler in a movement direction along the movement axis as the expanding material expands;

an inhibiting portion coupled to one of the electrical coupler and the wall of the cavity, the inhibiting portion applying a second force against the other of the electrical coupler and the wall of the cavity to inhibit movement of the electrical coupler along the movement axis; and a second housing electrically coupled to the second electrical contact, wherein the apparatus is configured such that, in a case that the electrical coupler moves a predetermined distance in the movement direction from the initial position, the electrical coupler physically contacts the second housing, and the first electrical contact is electrically coupled to the second electrical contact via the electrical coupler, the first housing, and the second housing.

2. The apparatus of claim 1, wherein the second force is in one or more directions non-parallel with the movement axis.

3. The apparatus of claim 1, wherein the electrical coupler includes a piston.

4. The apparatus of claim 1, wherein the electrical coupler includes two or more pistons.

5. The apparatus of claim 1, wherein the inhibiting portion includes a plurality of springs.

6. The apparatus of claim 5, wherein the plurality of springs include a plurality of spring leaves disposed at regular intervals along the circumferential surface of the electrical coupler.

7. A method of modifying a path within an electrical circuit, comprising:

providing an electrical coupler formed of an electrically conductive material at an initial position in a cavity of a first housing, wherein:

(i) the electrical coupler is moveable within the cavity along a movement axis, (ii) a wall of the cavity is electrically coupled to a first electrical contact and to the electrical coupler, and (iii) when the electrical coupler is disposed at the initial position, the electrical coupler is not electrically coupled to a second electrical contact;

applying, in a case that an ambient temperature exceeds a predetermined temperature, a first force on the electrical coupler in a movement direction along the movement axis, the force being applied based on expansion of a material that expands as the ambient temperature exceeds the predetermined temperature;

applying a second force on one of the electrical coupler and the wall of the cavity, the second force inhibiting movement of the electrical coupler along the movement axis; and physically contacting, in a case that the electrical coupler moves a predetermined distance in the movement direction from the initial position, the electrical coupler and a second housing, such that the first electrical contact is electrically coupled to the second electrical contact via the electrical coupler, the first housing, and the second housing.

8. A method of producing an electrical circuit path modifier that includes an electrical coupler, a driving portion, and an inhibiting portion, wherein the electrical coupler is electrically coupled to a first electrical contact but is not electrically coupled to a second electrical contact when disposed at an initial position, and is electrically coupled to both the first electrical contact and the second electrical contact when disposed at a second position, the method comprising:

setting a plurality of deployment parameters for the electrical circuit path modifier, the deployment parameters including:

a condition under which movement of the electrical coupler from the initial position to the second position initiates, and a timing for the electrical coupler to move from the initial position to the second position upon the condition being satisfied;

determining, based on the timing and a distance between the initial position and the second position, a rate of movement of the electrical coupler; and determining, based on the rate of movement:

at least one first parameter for the driving portion, the driving portion producing a first force causing movement of the electrical coupler from the initial position to the second position upon the condition being satisfied, and at least one second parameter for the inhibiting portion, the inhibiting portion producing a second force, the second force inhibiting the movement of the electrical coupler from the initial position to the second position.

9. The method of claim 8, wherein the condition is a current passing through the first electrical contact exceeding a predetermined threshold.

10. The method of claim 8, wherein the driving portion includes a wax disposed in a cavity, and wherein the at least one first parameter includes a size of the cavity.

11. The method of claim 8, wherein the inhibiting portion includes one or more inhibitors, wherein the at least one second parameter includes (i) a quantity of the one or more inhibitors and (ii) a force produced by each inhibitor.

12. The method of claim 8, wherein the inhibiting portion includes one or more inhibitors, wherein the at least one second parameter includes one or more of (i) a quantity of the one or more inhibitors and (ii) a force produced by each inhibitor.

13. The method of claim 12, wherein the one or more inhibitors are springs.

14. The method of claim 8, wherein the second force is in one or more directions non-parallel with a movement axis between the initial position and the second position.

15. The method of claim 14, wherein the second force is in one or more directions orthogonal with the movement axis.

* * * * *